US006620518B2

(12) United States Patent
Lavery et al.

(10) Patent No.: US 6,620,518 B2
(45) Date of Patent: Sep. 16, 2003

(54) VAPOR PHASE CO-DEPOSITION COATING FOR SUPERALLOY APPLICATIONS

(76) Inventors: Patrick R. Lavery, 259 Campbell Rd., North Andover, MA (US) 01845; Alan C. Banner, 11 Buttonwood Dr., Derry, NH (US) 03038; James Pollock, 22 Riverview Dr., Middleton, MA (US) 01949

( * ) Notice: Subject to any disclaimer, the term of this patent is extended or adjusted under 35 U.S.C. 154(b) by 0 days.

(21) Appl. No.: 09/778,190

(22) Filed: Feb. 7, 2001

(65) Prior Publication Data

US 2002/0031683 A1 Mar. 14, 2002

Related U.S. Application Data

(63) Continuation of application No. 09/373,336, filed on Aug. 12, 1999, now abandoned.
(60) Provisional application No. 60/096,869, filed on Aug. 17, 1998.

(51) Int. Cl.[7] ..... B32B 15/00; F03B 3/12
(52) U.S. Cl. ..... 428/450; 428/446; 428/610; 428/650; 420/548
(58) Field of Search ..... 428/446, 610, 428/650, 678, 680, 450; 148/437; 420/548

(56) References Cited

U.S. PATENT DOCUMENTS

| | | | |
|---|---|---|---|
| 3,779,719 | A | 12/1973 | Clark et al. |
| 4,293,338 | A | 10/1981 | Rose et al. |
| 4,933,239 | A | 6/1990 | Olson et al. |
| 5,071,678 | A | 12/1991 | Grybowski et al. |
| 5,482,578 | A | 1/1996 | Rose et al. |
| 5,492,726 | A | 2/1996 | Rose et al. |
| 5,547,770 | A | 8/1996 | Meelu et al. |
| 5,688,607 | A | 11/1997 | Rose et al. |
| 5,795,659 | A | 8/1998 | Meelu et al. |

*Primary Examiner*—Deborah Jones
*Assistant Examiner*—Jennifer McNeil
(74) *Attorney, Agent, or Firm*—Edwards & Angell, LLP

(57) ABSTRACT

The present invention relates generally to an oxidation and corrosion resistant coating composition produced by a vapor phase co-deposition of transition metals on metallic components. In particular, this coating includes aluminum and silicon and the coated substrate may comprise precious metal, nickel, cobalt or MCrALY. Such coatings are particularly useful in protecting nickel and cobalt and iron-based superalloys from heat corrosion and oxidation attack, especially during high temperature operation, e.g., gas turbine and jet engine hot zones.

8 Claims, 6 Drawing Sheets

CM 186LC PINS COATED WITH Al-Si (Low Silicon Ratio)

CM 188LC PINS COATED WITH Al-Si (High Silicon Ratio)

Vapor Al-Si Coating on GX-4 Alloy

VAPOR PHASE CO-DEPOSITION COATING FOR SUPERALLOY APPLICATIONS

This application is a continuation of application Ser. No. 09/373,336, filed Aug. 12, 1999, now abandoned, and claims priority to provisional application No. 60/096,869, filed Aug. 17, 1998.

BACKGROUND OF THE INVENTION

The present invention relates generally to an oxidation and corrosion resistant coating. More particularly, the present invention relates to a coating composition that is produced by a process for co-depositing transition metals on metallic components. This coating is particularly useful in protecting nickel and cobalt and iron-based superalloys from heat corrosion and oxidation attack, especially during high temperature operation. Such coating includes aluminum and silicon and the coated substrate may comprise precious metal, nickel, cobalt or MCrALY. Such coated substrates are particularly useful in gas turbine and jet engine hot zones.

BRIEF DESCRIPTION OF THE PRIOR ART

There are numerous applications in which metal components are exposed to elevated temperatures for prolonged periods of time. In such applications, it is important that the metal components retain their solid strength and mechanical properties after repeated exposures to high temperatures. High temperature operation is often found in turbomachinery blading members such as turbine blades, vanes, nozzles etc. used in aerospace and land-based machinery wherein the temperature of the component, or portion of the component, may rise to well above 1500° F. (815° C.). For example, modern gas turbine engines, commonly known as "jet engines," frequently operate in high temperature environments in excess of 2000° F.

Components manufactured from what has become known in the art as "superalloy materials" are recognized as generally providing for a higher degree of shape retention, and significantly more strength retention, at a wider variety of temperatures than non-alloy materials. Superalloys include metals containing high nickel, high cobalt and high nickel-cobalt-base. While often exhibiting more desirable mechanical properties at high temperatures, superalloys frequently suffer, as many other metals and alloys, from oxidation, sulfidation and corrosion degradation reactions (as for example when such component is exposed to salt spray and sulfur compounds), all of which are accelerated at high temperatures. While the efficiency of a gas turbine engine generally increases with increasing nominal operating temperature, the ability of turbine blades and vanes made from superalloys to operate at increasingly great temperatures is limited by the ability of the turbine blades and vanes to withstand the heat, oxidation and corrosion effects of the impinging hot gas stream.

Superalloy components are frequently coated with materials that are less prone to such degradation reactions or which form an adherent oxide scale which protects the superalloy material from such reactions. Such degradation-resistant coatings often incorporate elements such as aluminum, silicon, chromium, and platinum group metals, and may comprise composite alloys such as MCrAlY, where M is selected from the group consisting of iron, nickel, cobalt, and various mixtures thereof. A thermal barrier coating, such as a ceramic, may also be bonded to a degradation-resistant coating to further insulate the component from the high temperature, as such ceramic materials often do not directly adhere to the oxidized superalloys themselves. Degradation-resistant coatings and thermal barrier coatings can markedly extend the service life of gas turbine engine blades, vanes, and the like.

Degradation-resistant coatings are often chosen to provide high resistance to oxidation or hot corrosion, with little regard to the mechanical properties of the coating. Degradation-resistant coatings are typically applied in a thickness of 0.001–0.010 inches. Components may be coated differentially depending on whether one or more areas of the component is subjected to more or less degradative environments. Preferably, the degradation-resistant coatings should not crack when subjected to mechanically or thermally-induced strain. If the degradation-resistant coating is designed to form a protective oxide scale on the component, such scale preferably should not be dissolvable in liquids which may come in contact with the coated component.

A wide variety of techniques and processes are known for applying a degradation-resistant coating or layer to the surface of metal articles. Such techniques include diffusion coating, physical vapor deposition, plasma spray, and slurry coating.

Diffusion Coating

In diffusion coating, elements such as Al, Cr, Si, and/or Ti are reacted with halogenated activator at elevated temperatures to form gaseous species of Al, Cr, Si, and/or Ti which condense on the substrate and form a coating. Pack cementation is one of the most commonly employed diffusion coating techniques wherein the parts to be coated are placed in surface contact with the coating source material.

An early example of aluminum-silicon co-deposition by pack cementation is set forth in U.S. Pat. No. 3,779,719 to Clark et al. The Clark et al. reference discloses that mixtures of aluminum, silicon and chromium heated at about 1750° F. for 8 to 12 hours to a maximum coating temperature of 1900° F. produce, by diffusion of such materials into the substrate, corrosion resistant coatings and that performance is enhanced when the silicon content is at least 5% by weight and the Si/Cr weight ratio is within the range of 0.6 to 1.4. A silicon pack cementation process is also described in U.S. Pat. No. 4,369,233 to van Schaik, wherein a silicon containing coating is produced by overcoating surfaces previously treated with active metal species, such as Y or Ti. Preferably, the active metal is said to be ion plated, diffused in a vacuum, and mechanically treated prior to application of the silicon. The van Schaik reference suggests that a protective coating of ternary silicides, such as $Ti_6Ni_{16}Si_7$ and $Ni_{49}Ti_{14}Si_{37}$, is formed. Likewise, U.S. Pat. No. 5,492,727 to Rapp et al. describes a pack cementation process wherein chromium and silicon are co-deposited onto ferrous substrates utilizing a dual activator system in a two-step heating cycle.

Physical Vapor Deposition

In physical vapor deposition techniques ("PVD"), metallic components which are to be incorporated into a coating are applied by means of vaporization. Numerous physical vapor deposition techniques have been described in the literature and include above-the-pack ("ATP"), chemical vapor deposition ("CVD"), and electron beam physical vapor deposition ("EB-PVD"). ATP processes are accomplished in a manner similar to pack cementation, however, the substrate is held out-of-contact with the metal containing and activator containing source materials, and a coating forms by physical vapor deposition and diffusion of metal onto and into the substrate. The metal source may be present in powdered form or as metallic chunks. CVD, a specialized form of vapor coating, is usually accomplished using a starting gas. The gas can either be the source of the deposited metals or can be the reactant used to generate the metallic vapor done by passing it over or through a bed of metallic source. CVD processing typically requires more stringent processing controls and cleaner source materials. EB-PVD functions by creating a molten pool of metal from which material evaporates and then deposits on the substrate in a line-of-sight path. ATP, CVD, and EB-PVD processes typically result in coatings that are smoother, cleaner and cosmetically improved compared to parts coated by pack cementation. Numerous examples of ATP, CVD, and EB-PVD and other types of physical vapor deposition processes can be found in the art. The list of reactant sources, materials and substrates used in such processes is long and varied.

U.S. Pat. No. 3,486,927 to Gauje (SNECMA Corp.) discloses a method for vapor depositing aluminum to make a coating that protects metal articles subject to high temperature. At the Third International Conference on Chemical Vapor Deposition (Salt Lake City, Utah 1972), Felix and Beutler demonstrated coated nickel superalloys by CVD methods in a stream of silicon tetrachloride and hydrogen at 980° C. to 1080° C. Resultant coatings were said to be upwards of 10 mils thick with upwards of 25% silicon. Increased corrosion protection was claimed for such coating.

U.S. Pat. No. 4,371,570 to Goebel et al. discloses an overlay coating for superalloys, the outer layer of which is silicon enriched, wherein the surface layer is produced by diffusing silicon via, among other methods, physical vapor deposition (see col. 4, lines 27–60). The Goebel et al. patent describes physical vapor deposition wherein the article to be coated is held over a molten pool of silicon in a vacuum chamber and the surface of the substrate is preferably heated at 1750° F. as the silicon vapors condense on the substrate. Further heat treatment to 1850° F. is said to promote further diffusion of the silicon into the overlay coating. The Goebel et al. reference discloses increased corrosion protection when a composite coating formed by siliconizing over MCrAlY-type coatings is performed, and in particular when the outer layer coating is rich in silicon.

Likewise, U.S. Pat. No. 5,217,757 to Milaniak et al. discloses a powder mixture for applying gas phase aluminide coatings to nickel or cobalt based superalloys. The Milaniak et al. reference describes a powder mixture consisting essentially of about 5–20 weight percent ammonium bifluoride as an activator (or halides (preferably fluorides) of alkali or alkaline earth metals), 10–30 weight percent chromium as buffer and a balance of $Co_2Al_5$. The Milaniak et al. reference states that elimination of aluminum oxide as a powder constituent dramatically improves the quality of the aluminide coating.

Moreover, U.S. Pat. No. 5,492,726 to Rose et al. discloses a process for applying a protective coating to nickel and/or cobalt-based superalloys involving applying a thin layer of a platinum-group metal onto the surface of a superalloy, heating the superalloy in the presence of a silicon vapor to diffuse the resulting platinum-group metal silicide into the superalloy surface, diffusion coating the silicided superalloy with vapors of a diffusion powder composition containing sources of aluminum, and heating the superalloy to form a ductile protective coating. Such coating is said to comprise an outer zone of an aluminide of said platinum-group metal and an inner stabilizing zone of silicided platinum-group metal comprising from 3 to 20% by weight silicon.

U.S. Pat. No. 4,034,142 teaches application of Al, Cr, Si and Y to the surface of superalloys by sputtering, a physical vapor deposition technique, or by an EB-PVD method. The Si, at 0.5 to 7.0 weight percent, is present in elemental form as a solid solution in both the gamma and beta phases of the nickel aluminide coating. U.S. Pat. No. 4,933,239 to Olson et al., discussed below with respect to plasma spray techniques, also discloses that its overlay coating can be applied by EB-PVD.

Many different apparatuses utilizing physical vapor phase deposition methodologies are described in the art, the design often varying with respect to the particular industry in which such technology is employed, e.g., aerospace vs. semiconductor industries. For example, several patented equipment designs and processes are described in U.S. Pat. Nos. 5,462,013, 5,407,704, and 5,264,245 to Howmet Corporation, wherein it is disclosed, among other things, that varying temperature locally to match local metal halide reactivity enhances the uniformity of aluminide coatings.

Plasma Spray

Another coating method frequently employed to form degradation-resistant coatings is the so-called "plasma spray" method. Plasma sprays incorporate mixtures of powders that are made molten and sprayed onto substrates at very high velocity and temperature. Plasma spray coatings typically have good corrosion resistance due to high Cr content and fairly good oxidation resistance due to the presence of Al and Y or Hf. Such coatings typically have a matrix of MCrAlYX(Hf). Examples of plasma spray techniques include vapor plasma spray ("VPS"), high velocity oxygen fuel spray ("HVOF"), low pressure plasma spray ("LPPS"), and air plasma spray ("APS").

U.S. Pat. No. 4,615,864 to Dardi et al. teaches that a plasma spray coating containing 5 to 15% wt % aluminum, up to 12 wt % silicon, and various other active metals, such as Hf or Y, improves resistance to sulfidation and oxidation reactions. The Dardi et al. reference also contemplates ion plating and physical vapor deposition methods for the application of various coatings.

U.S. Pat. No. 4,933,239 to Olson et al. discloses an improved coating that is produced in a two-step process which may employ plasma spray techniques encompassing over-aluminizing a thin, nominally 0.0015", metallic overlay coating containing Si, Y and Hf. The Olson et. al. reference describes a duplex microstructure comprising about 20–35 weight percent aluminum enriched with about 0.1–5.0 weight percent yttrium, about 0.1–7.0 weight percent silicon and about 0.1–2.0 weight percent hafnium.

U.S. Pat. Nos. 5,401,307 and 5,582,635 to Czech and Schmiz describe plasma sprayed and PVD deposited MCRAlY coatings containing 1–2% silicon that have improved corrosion resistance and ductile-to-brittle transition temperature below 500° C.

Slurry Coating

Slurry coating may also be used to form degradation-resistant coatings. Slurry coatings are typically applied by dip or paint spray application techniques. The slurry may be applied in single or multiple steps, before firing to form the coating. Typical slurry coatings are heated to between 1600° F. and 2000° F. U.S. Pat. No. 3,741,791 to Maxwell et al. discloses a paint slurry coating for superalloys containing MCrAlYSi. Silicon content in the described Maxwell et al. slurry is disclosed to be in the range of 10% -16%. The Maxwell et al. reference further discloses applying the slurry to substrate material heated to 2100° F.–2225° .F to cause the slurry to become molten on the substrate surface thereby dissolving some of the substrate while the material diffuses into the substrate material.

U.S. Pat. No. 4,310,574 to Deadmore et al. describes a method for aluminum and silicon application that requires spraying a lacquer slurry comprising cellulose nitrate containing high purity silicon powder and subsequently pack-aluminizing the silicon slurry sprayed superalloy substrate. A sublayer of high purity silicon in an aluminide structure characterizes the resultant coating.

U.S. Pat. No. 4,500,364 to Krutenat describes a slurry method for the application of aluminum and silicon to iron-based materials. This slurry method is similar to that described in U.S. Pat. No. 4,310,574 above, where eutectic compositions of aluminum and silicon in binder systems are sprayed onto superalloy surfaces and thermally diffused. The slurries become molten in processing and produce coatings that have high levels of silicon in the outer layers. Silicides and elemental silicon are disclosed to be present.

U.S. Pat. No. 5,547,770 to Meelu et al. may be said to present an advancement in slurry Al—Si coatings. Such coating is multi-layered and silicon-enriched and is produced by multiple and sequential slurry-spray-and-diffuse cycles. This coating limits the silicon content of the coating directly adjacent to the surface to a maximum of 10% and also forms multiple bands of chromium-silicon spaced inside the aluminide coating. Diffusion of nickel and chromium from the base metal into the coating zone are disclosed to improve coating performance. Such coating is disclosed as reducing silicon-induced surface brittleness, associated with prior art coatings, while increasing the corrosion resistance through the presence of an equally spaced sublayer of chromium silicide bands. Diffuse distribution of the silicide phases has been reported to enhance coating performance. See Berry et al., International Gas Turbine and Aeroengine Congress and Exposition, Jun. 5–8, 1995. A coating based on the Meelu et al. disclosure is produced commercially and known in the industry under the trade name SERMALOY™ 1515.

The presently available coating deposition techniques suffer from a number of disadvantages. For example, pack cementation, plasma spray, and slurry deposition methods are less than desirable when parts of relatively complex design, having internal passages and the like, are to be coated. Such techniques may clog or obstruct small internal passages, mandating a thorough cleaning of the part prior to shipment. On the other hand, physical vapor deposition techniques (such as ATP, CVD and EB-PVD), while avoiding such clogging problems and in general permitting more uniformity in thickness and composition, as currently employed, often require multi-step processes to produce many types of multiplex coatings.

Among the degradation-resistant coatings available today, it is recognized in the art that degradation-resistant coatings comprising Al—Si offer significant advantages, such as increased ductility and corrosion protection. Al—Si degradation resistant coatings typically contain more than 0.5 weight percent Si and may contain numerous other elements and compounds thereof. U.S. Pat. No. 5,057,196 to Creech et al. describes a two-step process for producing a Pt-Si-Al coating on superalloys. The critical processing steps involve the electrophoretic co-deposition of platinum and silicon material, diffusion heat treatment, electrophoretic deposition of aluminum-containing material, and heat treatment.

U.S. Pat. No. 5,492,726 to Rose et al. describes a multi-step method for producing a platinum group silicon-modified aluminide to nickel and/or cobalt-based superalloys. This method involves applying a thin layer of a platinum-group metal on the superalloy, heating the superalloy over a thermal cycle in the presence of a silicon vapor phase to diffuse the resulting platinum-group metal silicide into the superalloy surface, diffusion coating the silicided superalloy with vapors of a diffusion powder composition containing sources of aluminum and heating the superalloy to form a ductile protective coating.

Much work has been undertaken with respect to the co-deposition of oxide forming species in order to reduce the time and expense involved with multi-step coating processes. However, with respect to the co-deposition of silicon and aluminum, successful co-deposition has only been effectuated by means of pack cementation, EB-PVD, plasma spray, and slurry coating techniques. Attempts to use the arguably more advantageous ATP or CVD techniques have been unsuccessful or uneconomical. In a work authored by R. Bianco and R. Rapp entitled "Pack Cementation Aluminide Coatings on Superalloys: Codeposition of Cr and Reactive Elements", Apr. 1993 (4), pages 1181–1190, the authors argue that while it is theoretically possible to co-deposit aluminum and silicon at high temperatures, using physical vapor deposition in levels of Si greater than 1 wt. % would be extremely difficult. These authors cite at least two major obstacles which need to be overcome in the co-deposition of silicon and aluminum by physical vapor deposition: (1) the formation of silicon carbide at the coating surface due to the high carbon content of many superalloys which inhibits the co-deposition and (2) the great difference between aluminum halide partial pressures and silicon halide partial pressures. Bianco and Rapp were unable to co-deposit such elements by conventional ATP means. Many others in the art do not believe that co-deposition using ATP techniques is possible.

Given the advantages associated with ATP techniques discussed above, the superior degradation-resistant coating formed with Al—Si, and the economic and time saving advantages of co-deposition, it would be highly advantageous to be able to employ ATP techniques to co-deposit Al and Si on superalloys and superalloys overcoated with MCrAlY coatings and precious metal materials. Furthermore, it would be advantageous to be able to co-deposit Al and Si using a relatively inexpensive methodology.

BRIEF SUMMARY OF THE INVENTION

In accordance with one embodiment of the present invention a degradation-resistant coating comprising Al and Si is formed by the process of: (a) furnishing a nickel, cobalt or iron-based superalloy substrate; (b) furnishing one or more powder mixtures containing from about 1 to about 10 percent Al and from about 1–20 percent Si; (c) heating the one or more powder mixture(s) at a temperature between about 1500° F. to about 2200° F.; (d) supporting the heated superalloy substrate out of contact with the heated powder mixture(s) at a distance such that vapor from said powder mixture(s) can contact with the superalloy substrate; (d) depositing an Al—Si containing coating on the superalloy substrate from about 1 to about 12 hours; (e) heating the superalloy substrate to form a protective layer containing aluminum and silicon at the surface of the substrate.

The present invention relates to a simplified process for applying a protective coating containing aluminum and silicon onto metallic bodies or components by means of vapor deposition.

More particularly, the present invention relates to a process whereby aluminum and silicon may be co-deposited onto metallic superalloys utilizing ATP techniques.

Further, the present invention relates to an improved aluminum and silicon degradation-resistant coating formed by co-depositing aluminum and silicon by means of ATP techniques.

And yet further, the present invention relates to a vapor phase process, and a coating made utilizing such process, wherein aluminum and silicon are co-deposited in vapor phase in a temperature range of approximately about 1600° F.–2100° F. for more than approximately two hours to produce a coating thickness ranging from approximately 0.001" to approximately 0.005". And finally, the present invention relates to a co-deposited vapor Al—Si coating containing at least 6 wt. % Si and no more than 32 wt. % Al with the preferable ratio of SLIM in the range of 0.1–0.5, and more preferably the ratio being between 0.2–0.4.

DETAILED DESCRIPTION OF THE INVENTION

Figure 1:
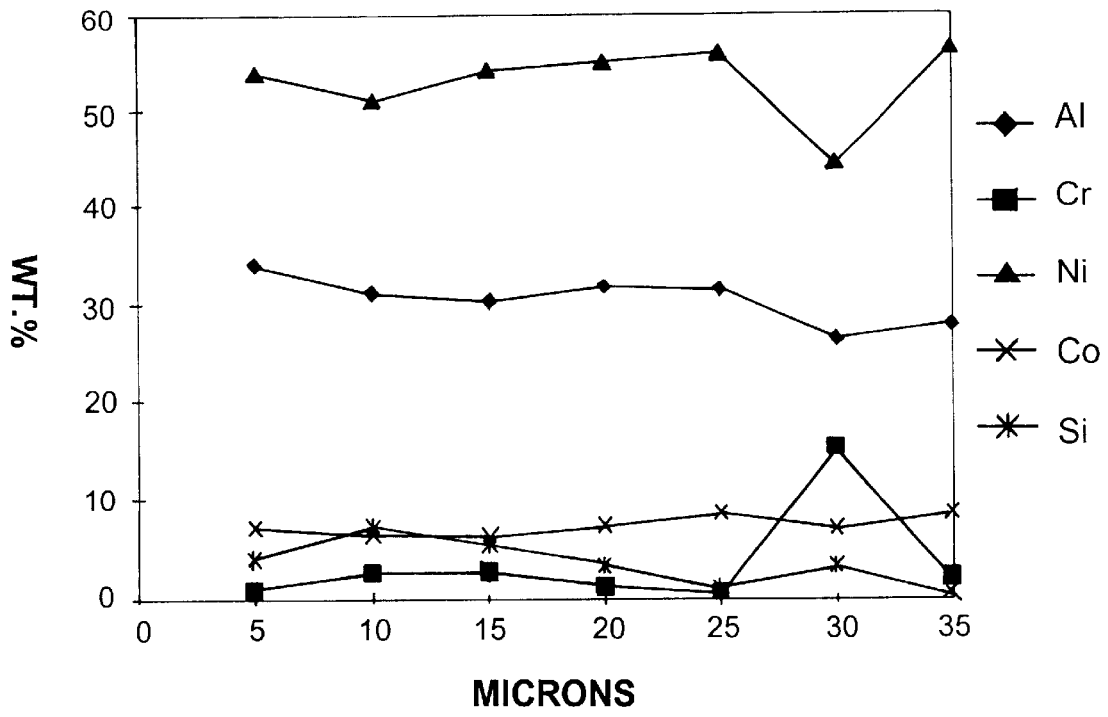
FIG. 1 is a graph interrelating average coat thickness to the weight composition of coat elements in a CMSX-4 nickel-based substrate coated with Al—Si by the process of the present invention.
Figure 2:
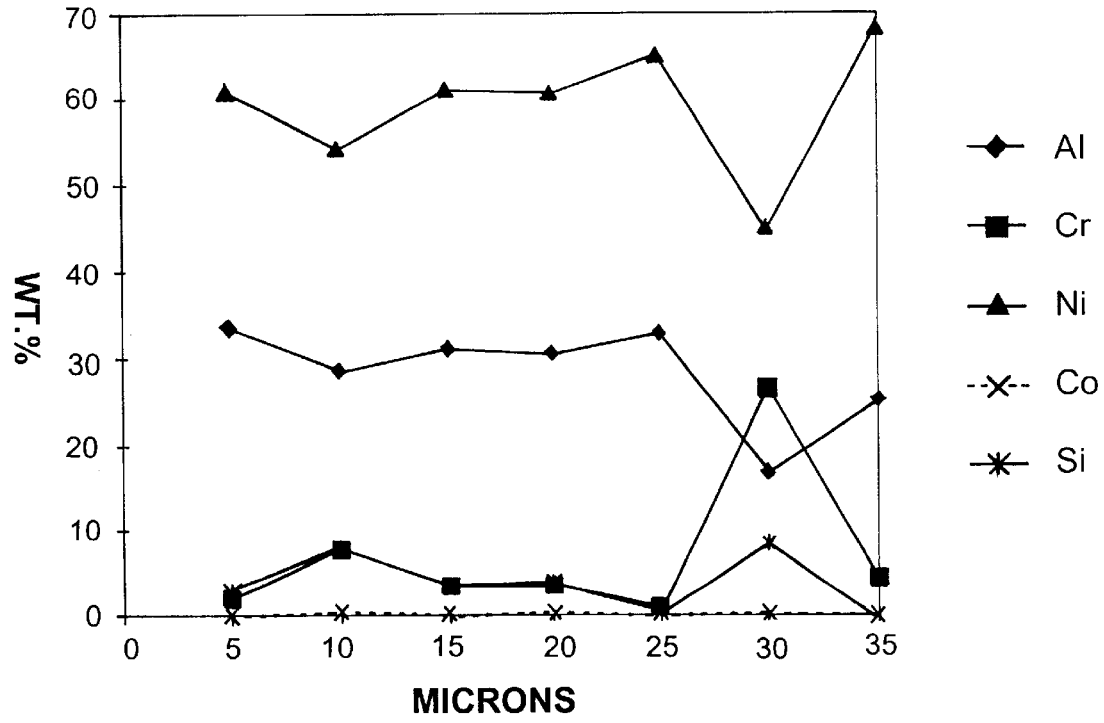
FIG. 2 is a graph interrelating average coat thickness to the weight composition of coat elements in a IN713 nickel-based substrate coated with Al—Si by the process of the present invention.
Figure 3:
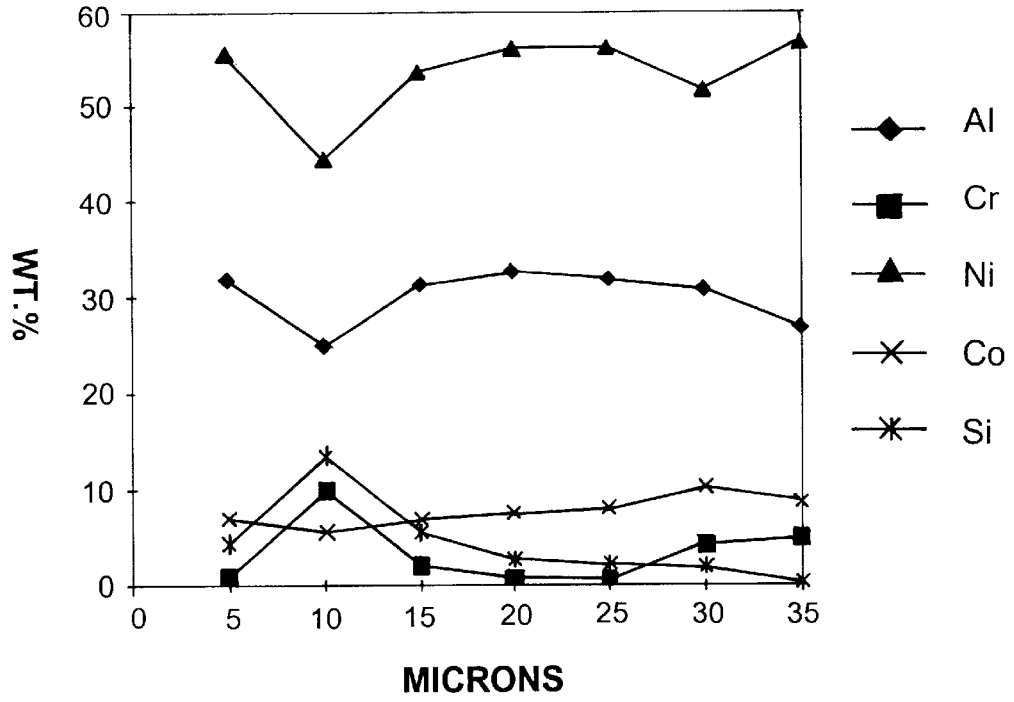
FIG. 3 is a graph interrelating average coat thickness to the weight composition of coat elements in a MAR-M-002 nickel-based substrate coated with Al—Si by the process of the present invention.

According to this invention, it has been found that aluminum and silicon can be caused to co-deposit on alloy metal substrates, in particular, those selected from the group of iron, nickel, cobalt, palladium, platinum, rhodium and chromium, through a vapor phase deposition process in which the aluminum and silicon are carried from one or more powdered mixtures to the surfaces of the substrate. The coating process of the present invention may be carried out at any of the conventional temperatures at which physical vapor deposition techniques such as ATP, CVD and EB-PVD are performed, but more preferably 1500° to 2100° F.

While the substrate to which the coating of the present invention may be applied is not limited by composition, the substrate may incorporate a quantity of, or contain a significant weight percent of, a metal such as nickel, cobalt, palladium, platinum and rhodium. Preferably, the substrate on which the coating is placed contains cobalt or nickel.

In general, the aluminum and silicon sources may be present in powdered or chunk form. The aluminum and silicon sources may be kept separated in two powder mixtures, or may be combined into one master mix. However, it has been found that for the same powder chemistries, that a combined mix may result in a Si content in the coating which is slightly lower than when the powders are kept separate. The powdered silicon source may also be replaced with an external source of silicon that is accomplished using hydrogen or argon as a carrier gas for gaseous silicon tetrachloride. The advantages of combined or separate mixes or external silicon supplies have not been fully investigated, but are not considered to be limitations to the process.

Preferably, the silicon to aluminum ratio is approximately 0.1–0.5, even more preferably between 0.2–0.4.

Preferably, two separate powder mixtures are prepared, one containing the source of aluminum for the coating, the other containing the source of silicon for the coating. Most preferably, the first powder mixture providing the source of aluminum may comprise by weight 1–10 percent $AlF_3$, 1–5 percent 200-mesh aluminum, and the balance 100-mesh aluminum oxide. Preferably, the second powder mixture providing the source of the silicon may comprise by weight 0.5–4 percent $NH_4Cl$, 1–20 percent 325-mesh silicon, and balance 100-mesh aluminum oxide.

The substrate and aluminum and silicon source materials are placed together in a retort and heated. Preferably, the sources of aluminum and silicon are separate mixtures each placed in a separate container in the retort. The substrate should be placed at a distance from the source materials such that vapor containing aluminum and silicon from the heated source materials impinges upon the surface thereof. Preferably, the substrate is supported at least 3 cm from the source materials with positioning being above or beside the source mix.

The powder mixture(s) are preferably heated at a temperature of 1700° F.–2100° F., more preferably at a temperature of 1800° F.–2000° F. and yet more preferably between a temperature of 1850° F.–1975° F. The substrate should preferably be heated in the same retort as the powdered mixtures, and thus heated to the same temperature range as the powder mixtures. Preferably the temperature of the retort is ramped up over time until the desired temperature of the coating is reached.

The substrate and source are exposed to a thermal cycle wherein aluminum and silicon start to deposit at about 1400° F. At higher temperatures, the rate of metallic gas production is accelerated and coating deposition is accelerated as the metallic vapors impinge on the substrate. Uniform dispersion of silicon in the nickel or cobalt aluminum matrix is achieved at 1600° F. or higher. Temperature holds at 1600° F., 1700° F., and even 1800° F. may be used, but are not necessary to the final microstructure and in some cases may be detrimental if final heating is 1850° F. or higher. For example, the retort may be heated to 1975° F. in 2–6 hours or more preferably in 3–4 hours, without holds at any lower temperature. The substrate shall remain in the coating vapors for 1–15 hours, more preferably 2–12 hours, and more preferably 4–8 hours. The duration at temperature is temperature, substrate, atmosphere and coating thickness dependent.

Preferably, heating is accomplished in a retort purged with either argon or hydrogen. The retort may either have forced gas flow impinging on the substrate surface or may be a sealed retort with no forced gas flow directly on the substrates and source. For example, the retort may be heated to in excess of 1300° F. in argon, and then switched to hydrogen flow and continued heating to 1850° F. or higher in 2–6 hours with optional holds at intermediate temperatures before reaching maximum coating temperature and holding for the required time of 1–15 hours. The substrate should preferably remain in the vapor phase preferably from 1–15 hours, more preferably 2–7 hours, and yet more preferably 3–6 hours.

The Al—Si degradation-resistant coating made by the process described above typically comprises at least three distinct aluminide zones. The coating is predominantly grown by outward diffusion of nickel and cobalt. As an example, the following can be said of a 75 micron thick coating. The outer most zone approximately 10–15 microns thick should be nearly free of chromium and refractory metal phases and low in chromium and refractory elements when compared to substrate base metal levels. The outer zone is a solid solution that usually contains only nickel, cobalt, aluminum, silicon, and chromium unless the substrate has been precoated with a platinum group metal. Nickel suicides and other suicides may be present but are note required for good performance. The next inner zone contains silicide phases of at least chromium. The third, inner most zone is the diffusion zone that usually contains the highest levels of silicon. The average weight percent of Al is preferably 18–32, more preferably 22–30, and yet more preferably 24–28. The weight percent of Si is preferably 1–20, more preferably 3–15 percent, and yet more preferably 6–9. The Si/Al ratio is preferably 0.1–0.5, more preferably 0.2-.04, and yet more preferably 0.22–0.32. The ratio of Si/Cr is not critical in coating of this invention. Coating thickness is preferably between 0.001"–0.006", more preferably 0.0015"–0.0045", and yet more preferably between 0.002"–0.004".

In general, if a bare nickel-based substrate is to be coated, a particularly advantageous Al—Si corrosion resistant coating of the present invention comprises 4–65 weight percent Ni, 18–32 weight percent Al, and 1–12 weight percent Si, more preferably 45–60 weight percent Ni, 20–30 weight percent Al, and 3–10 percent Si, and yet more preferably 48–55 weight percent Ni, 25–30 weight percent Al, and 5–10 weight percent Si.

If a cobalt-based substrate is to be coated, a particularly advantageous Al—Si degradation-resistant coating of the present invention may comprise 10–35 weight percent Al, 3–25 weight percent Si, and the remainder primarily Co and Ni, more preferably 20–30 weight percent Al, 5–15 weight percent Si, and the remainder primarily Ni and Co, and yet more preferably 22–28 weight percent Al, 6–15 weight percent Si, and the remainder primarily Co and Ni.

If the substrate is prepared with a precious metal coating such as platinum, the minimum content should be 15 weight percent with 18–32 weight percent Al and 1–12 weight percent Si, more preferably, 18–28 weight percent Al and 1–10 percent Si, and yet more preferably 18–26 weight percent Al and 1–6 weight percent Si.

Such Al—Si degradation resistant coatings have been discovered to provide superior protection against sulfidation attack at 800° C. and 850° C. and show acceptable oxidation resistance in standard testing at 1121° C. as compared to currently available Al—Si and chromide degradation resistant coatings. Performance is enhanced by at least a factor of 2 and by as much as a factor of 12. Sulfidation resistance is far superior to simple aluminides and platinum aluminides with improvement factors of at least 4 and as much as 25 times or more for both. In thermal-mechanical testing, the coating of this invention outperforms the best slurry AlSi coating by a measure of at least 4 times and is nearly equivalent to single phase CVD PtAl coating, the most ductile of the advanced aluminide coatings.

Although the invention is not limited by any hypothesis regarding the cause of such superior effect, it is hypothesized that the more uniform deposition of Si in nickel and cobalt aluminides resulting from vapor deposition (as opposed to other coating methods), as well as an outwardly grown coating with dispersed silicon, and greater control on maximum Al content as noted on electron microscopy, may account for the enhanced protection provided by the coatings formed using the present invention.

The above method differs from the literature in several ways. Firstly no prior art reference cites any method of co-deposition of Al and Si by vapor, nor does any reference indicate that such deposition technique has been successfully employed with Al and Si (although there are references that mention that it might be possible). Secondly, the literature cites examples using powder mixes usually containing high levels of Al and Si and sometimes Cr. Most often these mixtures are not made from elemental forms, but from costly alloy forms of Al, Si, and/or Cr. With the reduction in metal content and simplification of powder form, the method of the present invention has an inherently lower cost while affording the advantage of applying a variety of coating compositions that have not yet been available. The Si/Al ratio is preferably 0.1–0.5, more preferably 0.2-.04, and yet more preferably 0.22–0.32. The ratio of Si/Cr is not critical in coating of this invention.

The present invention is believed to provide an important advance in the art of degradation-resistant coatings, and in particular in the art of coating superalloy materials with Al and Si. The present invention provides an oxidation-resistant and corrosion-resistant coating system for protection of superalloy materials, in particular when such materials are to be incorporated into gas turbine components, and a process for preparing such protected components. The chemistry of the coating is modified from that of prior coatings to increase the adherence of the protective oxide scale and to increase the strength and diffusional stability of the coating while maintaining adequate resistance to corrosion by salts and sulfur and oxidation by high temperature exposure. The coating process described in the present invention not only permits co-deposition of Al and Si in an economical and time-saving manner, but also results in a Al—Si degradation-resistant coating which is superior to similar coatings deposited by processes presently employed in the art. For example, the process for coating of the instant invention may be optimized to provide increased performance and operating life of a gas turbine.

Other advantages of the invention will be apparent from the following more detailed description of the preferred embodiments, taken in conjunction with the accompanying drawings, which illustrate, by way of example, the principles of the invention. The following examples are meant to be illustrative rather than limiting.

EXAMPLES

The following commercially available alloys are used: MAR-M-002, CMSX-4, IN 713, CM186LC, and GX-4.

Example 1

A mixture comprising by weight, 10 percent $AlF_3$, 5 percent 200-mesh aluminum, 5 percent 325-mesh silicon, 1 percent $NH_4Cl$, and a balance of 100-mesh aluminum oxide is prepared. The mixture is pans on the bottom of a retort grid system and placed in a 30 inch diameter, pre-conditioned retort. A 1' square piece of CMSX-4 (prepared for coating by TIG welding a wire on one end, degreasing in solvent, grit blasting with #220 grit aluminum oxide, and blowing clean with air) is suspended over the mixture at a distance of 1 centimeter at room temperature. The retort is purged with $N_2$ for forty-five minutes at 375 cubic feet per hour (CFH). The retort is then purged with argon at 375 CFH for 1 hour. The retort is placed in a furnace and the temperature is ramped up in equal gradients to 1400° F. over a 2.5 hour period. The temperature is subsequently ramped up to 1600° F. over a 1 hour period of time, to 1965° F. over a 3 hour period, and is held at 1975° F. (+25° F./−10° F.) for 2.5 hours. At 1350° F. the retort is purged with $H_2$ at 375 CFH and the $H_2$ flow maintained at 375 CFH for the remainder of the coating cycle. The coated substrate is then cooled in $H_2$ at 375 CFH until the chamber temperature reached 400° F., wherein the cooling gas is changed to argon (for 1 hour at a minimum CFH of 375). A smooth silvery-white-gray coating of 0.002" to 0.003" in thickness is formed on the CMSX-substrate. Electron-microscopic analysis of the coating evidences three distinct aluminide structures in the coating.

Example 2

Two powder mixtures are prepared. The first powder mixture, the source of aluminum, consists of, by weight, 5 percent $AlF_3$, 2 percent 200-mesh aluminum, and balance 100-mesh aluminum oxide. The second powder, the source of the silicon, consists of, by weight, 0.5 percent $NH_4Cl$, 10% 325-mesh silicon, and balance 100-mesh aluminum oxide. The powders are placed in separate containers in the same coating vessel at a ratio of approximately 6 parts aluminum mix to 1 part silicon mix. Nickel-base superalloy substrates, IN738, MAR-M-002 and CMSX-4 are cut into 1" square tabs. Specimens for coating were prepared for coating by TIG welding a wire on one end, degreasing in solvent, grit blasting with #220 grit aluminum oxide, and blowing clean with air. The parts are suspended above the powders a minimum of one centimeter at room temperature. The coating vessel containing the powder and parts is placed in a coating retort and then with $N_2$ for forty-five minutes at 375 CFH. The retort is then purged with argon at 375 CFH for 1 hour. The retort is placed in a furnace and the temperature ramped up in equal gradients to 1400° F. over a 2.5 hour period. The temperature is subsequently ramped up to 1600° F. over a 1 hour period of time, to 1965° F. over a 3 hour period, and held at 1975° F. (+25° F./−10° F.) for 2.5 hours. At 1350° F. the retort is purged with $H_2$ at 375 CFH and the $H_2$ flow maintained at 375 CFH for the remainder of the coating cycle. The coated substrate is then cooled in $H_2$ at 375 CFH until the chamber temperature reached 400° F., wherein the cooling gas is changed to argon (for 1 hour at a minimum CFH of 375).

A smooth, silvery-white-gray coating is formed on all substrates tested. Depending on the coating zone, and the distance of the substrate from the source, the aluminum content ranges between 15–40 weight percent and the silicon content ranges between 1–20 weight percent, depending on location in the coating. The coating thickness ranges from 0.002–0.006".

Figure 7:
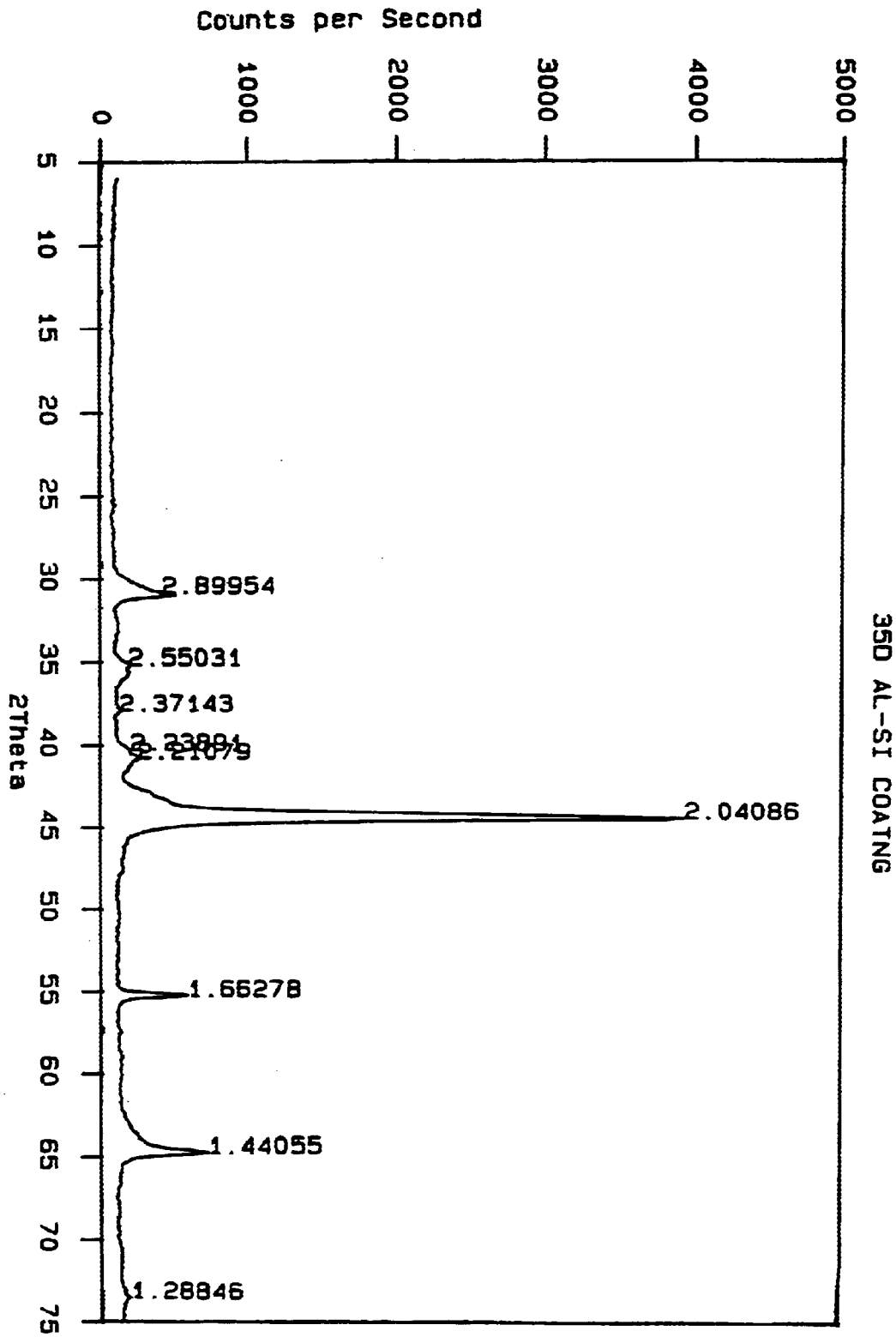
FIG. 7 is an energy dispersive spectroscopy plot for an exemplary CMSX-4 substrate coated with Al—Si by the process of the present invention.
Figure 8:
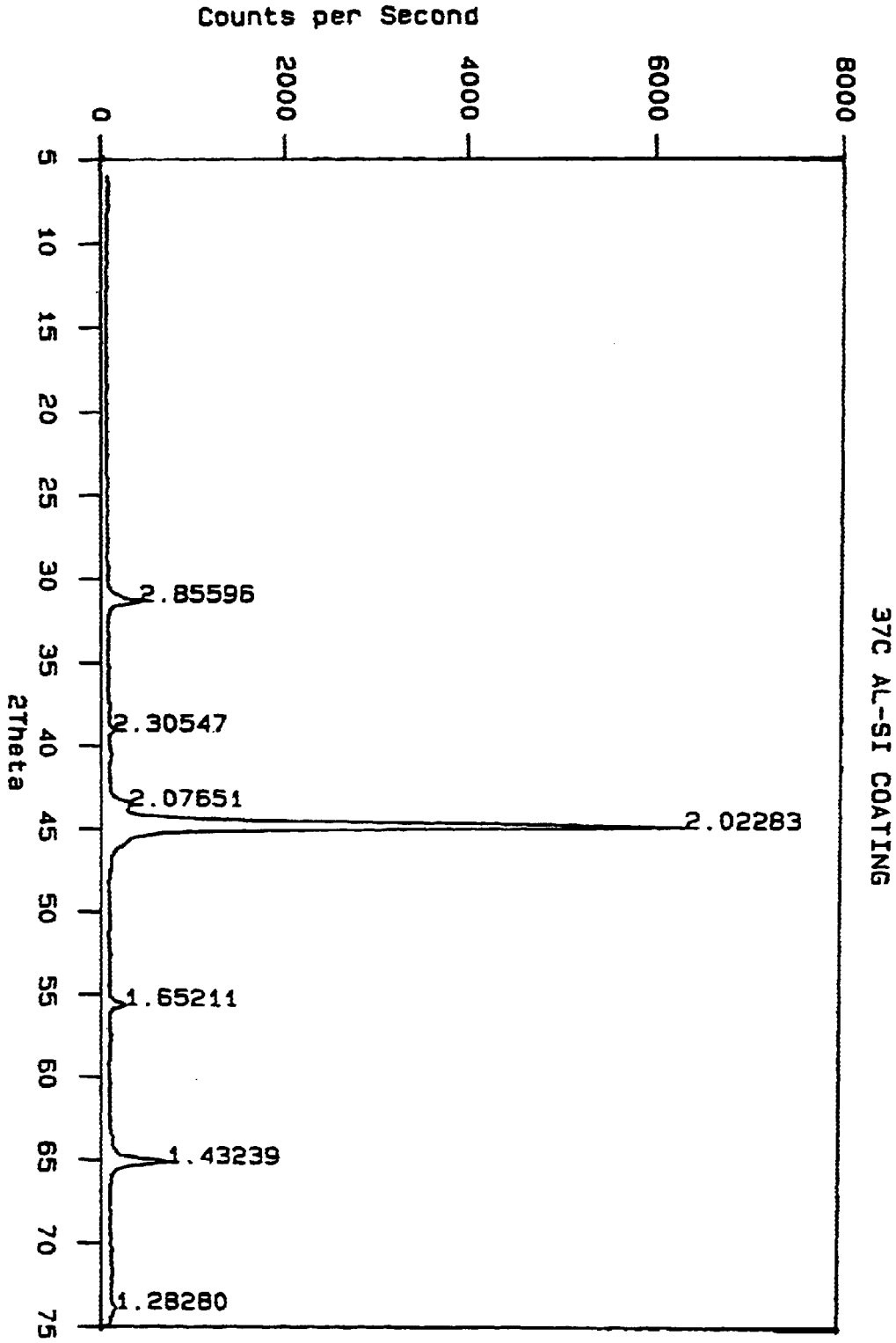
FIG. 8 is an energy dispersive spectrascopy plot for an exemplary IN713 substrate coated with Al—Si by the process of the present invention.
Figure 9:
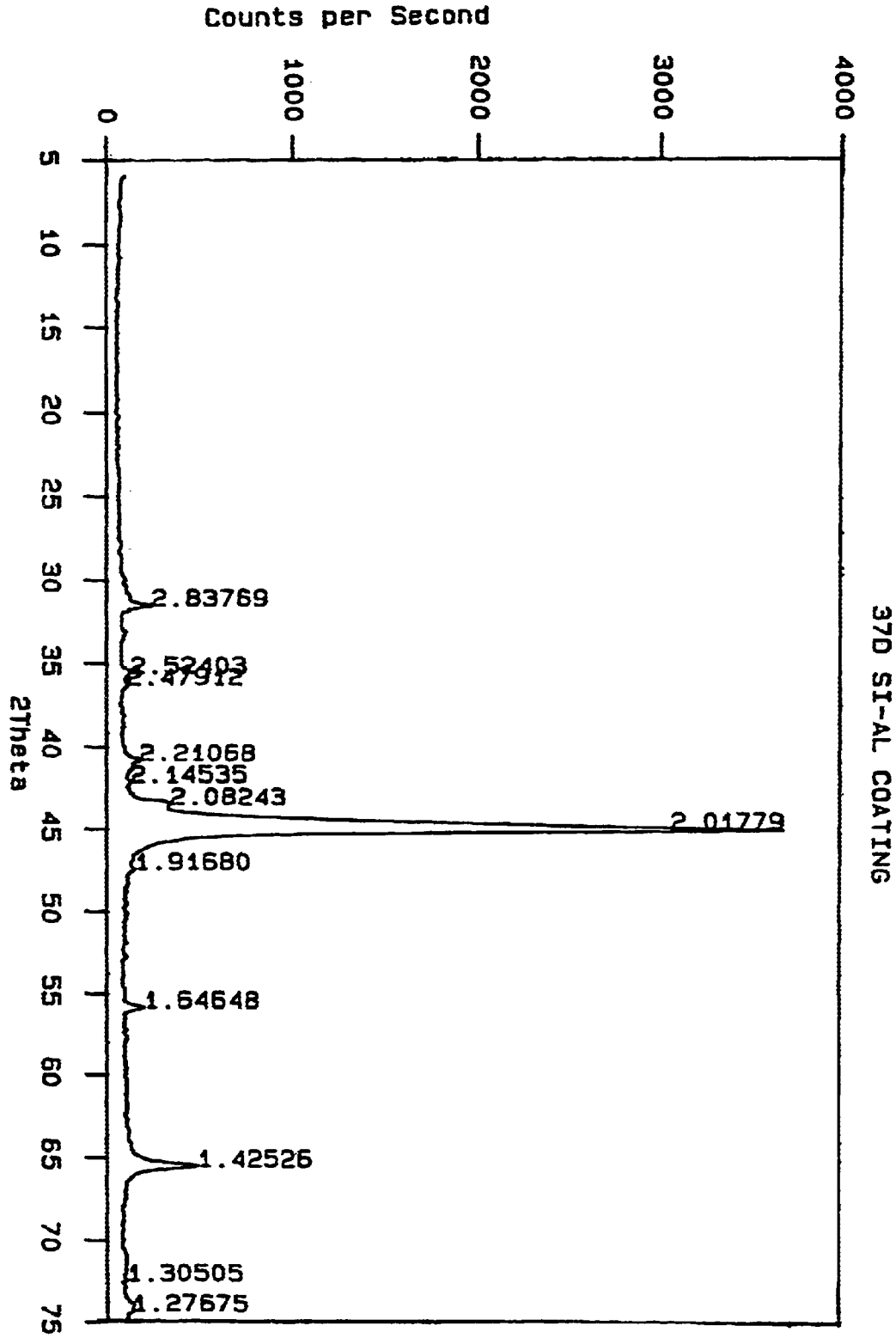
FIG. 9 is on energy dispersive spectroscopy plot for an exemplary MAR-M-002 substrate coated with Al—Si by the process of the present invention.

Plots of energy dispersive spectroscopy (EDS) for exemplary CMSX-4 substrate (See Tables IX and X, and FIG. 7), IN713 substrate (See Tables XI and XII, and FIG. 8) and MAR-M-002 substrate (See Tables XIII and XIV, and FIG. 9) are shown in the respective accompanying figures.

Example 3

The method of example 2 is repeated using as a substrate CM186LC single crystal pins of approximately 0.3" diameter×4" long. The coating formed is seen to be smooth, silvery-white-gray in appearance. Depending on the coating zone, and the distance at which the substrate is held from the source, the aluminum content of the coatings ranges between 15–35 weight percent and the silicon content ranges between 5–8 weight percent, depending on location in the coating. The coating thickness ranges from 0.002–0.003".

Figure 4:
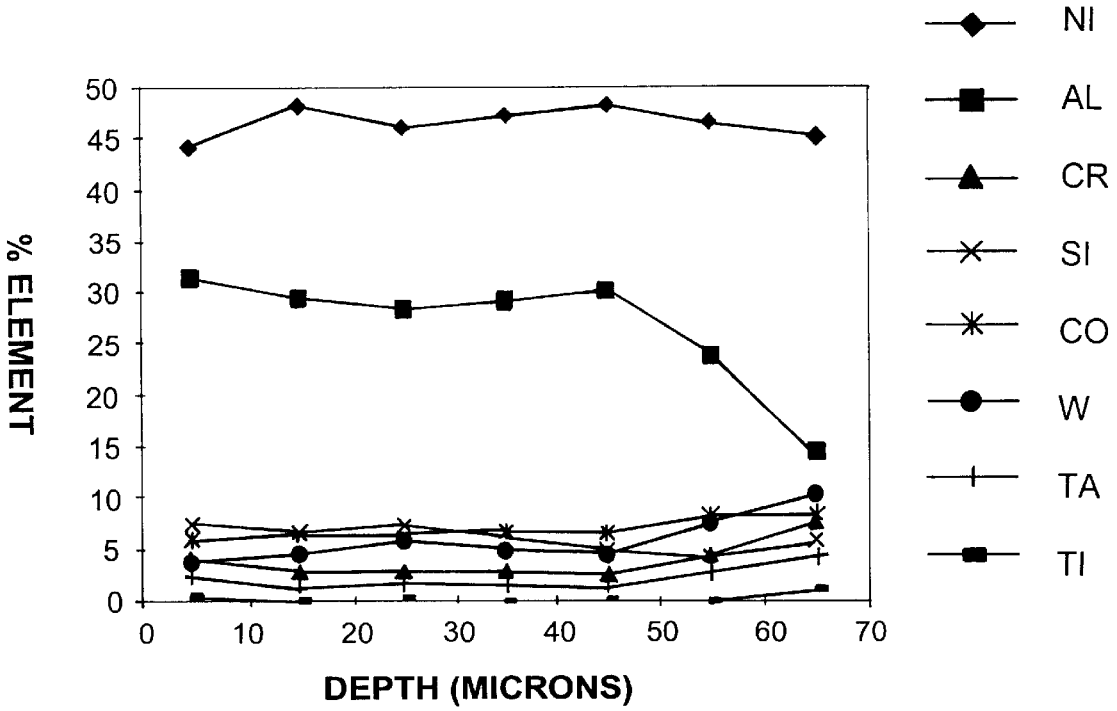
FIG. 4 is a graph interrelating average coat thickness to the weight composition of coat elements in a CM188LC nickel-based substrate coated with Al—Si by the process of the present invention.
Figure 5:
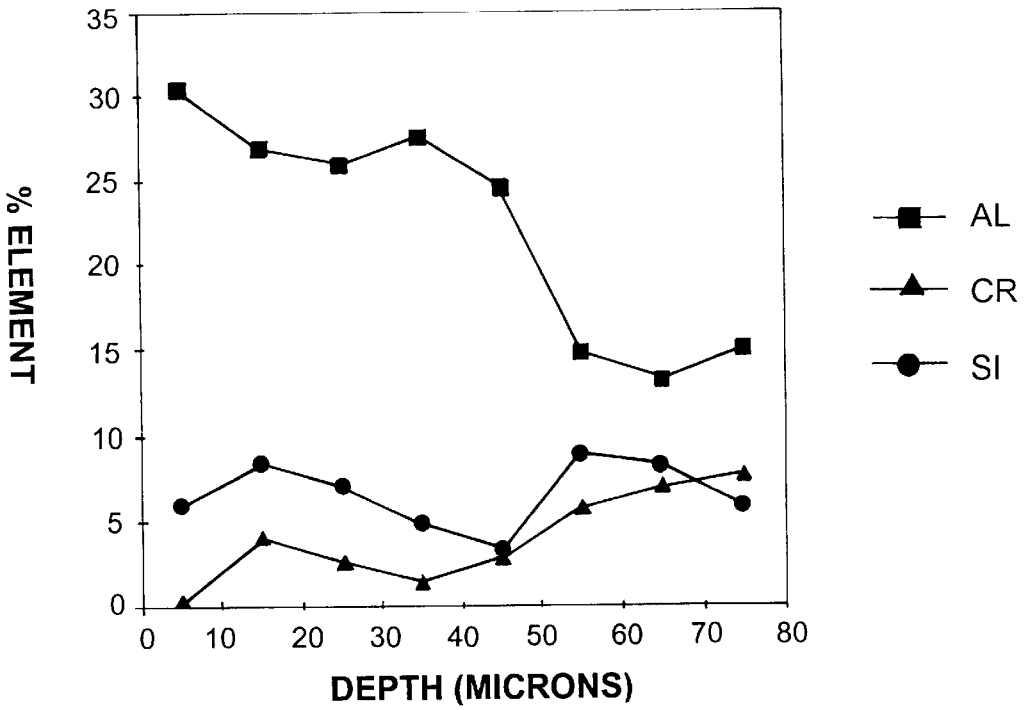
FIG. 5 is a graph interrelating average coat thickness to the weight composition of coat elements in a CM188LC nickel-based substrate coated with Al—Si by the process of the present invention.

Varying the Si content in the source powder over the ratio range yields varying composition profiles as shown in the difference between FIGS. 4 and 5, FIG. 4 representing the lower end of the range and FIG. 5 representing the higher end.

Example 4

The method of example 2 is repeated using a cobalt-based substrate GX-4. The substrate is cut into a 1" square and treated as the substrate samples described in example 2. The coating formed is seen to be smooth, silvery-white-gray in appearance. Depending on the coating zone, and the distance at which the substrate was held from the source, the aluminum content of the coatings ranges from 1–20 weight percent and the silicon content ranges between 2–25 weight percent, depending on location in the coating. The coating thickness ranges from 0.002–0.003".

Figure 6:
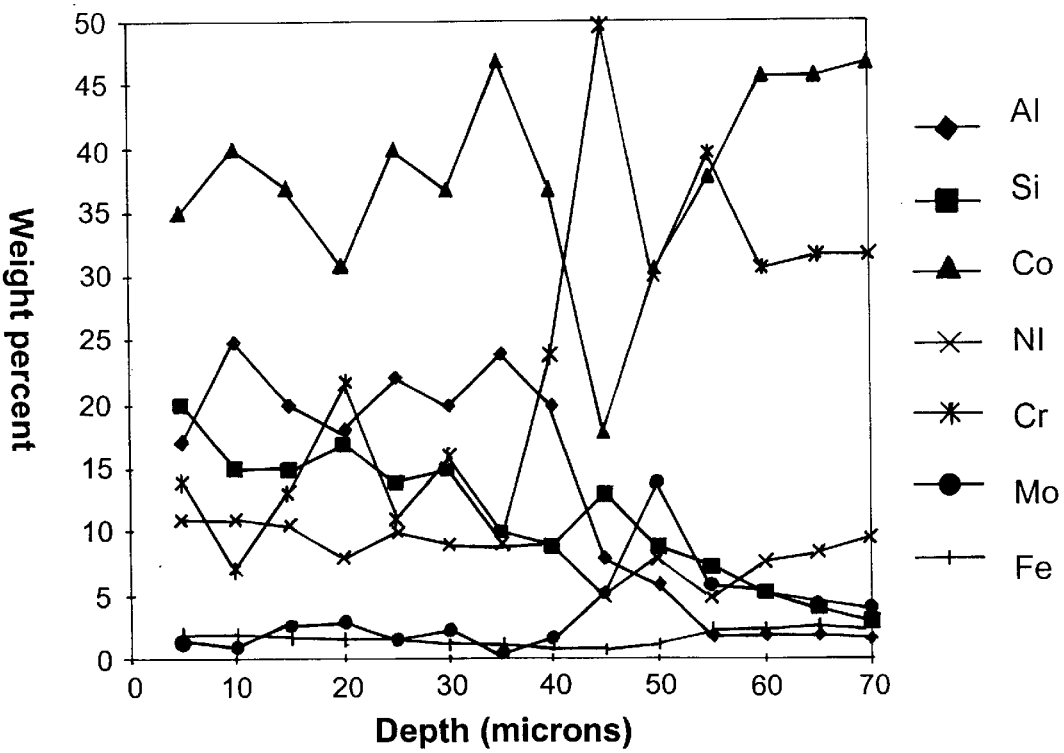
FIG. 6 is a graph interrelating average coat thickness to the weight composition of coat elements in a GX-4 cobalt-based substrate coated with Al—Si by the process of the present invention.

A graph interrelating average coat thickness to the weight composition of coat elements of exemplary GX-4 substrates coated in the above manner are presented in FIG. 6.

Additional data comparing various Al—Si coatings are attached.

Although the instant invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

TABLE I

CMSX-4 Al—Si as-coated

| DEPTH | % ELEMENT | | | | |
|---|---|---|---|---|---|
| MICRONS | AI | Cr | Ni | Co | Si |
| 5 | 34.03 | 0.98 | 53.87 | 7.12 | 3.85 |
| 10 | 31.21 | 2.5 | 51.44 | 6.53 | 7.49 |
| 15 | 30.47 | 2.76 | 54.76 | 6.59 | 5.45 |
| 20 | 32.09 | 1.28 | 55.61 | 7.57 | 3.48 |
| 25 | 32.07 | 0.66 | 56.59 | 9.04 | 1.46 |
| 30 | 27.18 | 15.97 | 45.32 | 7.69 | 3.64 |
| 35 | 28.67 | 2.83 | 57.45 | 9.18 | 0.96 |

TABLE II

IN713 Al—Si as-coated

| DEPTH | % ELEMENT | | | | |
|---|---|---|---|---|---|
| MICRONS | AI | Cr | Ni | Co | Si |
| 5 | 33.55 | 2.11 | 60.98 | 0.01 | 3.02 |
| 10 | 28.66 | 7.66 | 54.59 | 0.45 | 7.98 |
| 15 | 31.34 | 3.54 | 61.17 | 0.18 | 3.5 |
| 20 | 30.77 | 3.71 | 60.97 | 0.47 | 4.1 |
| 25 | 32.98 | 0.93 | 65.37 | 0.35 | 0.4 |
| 30 | 17.15 | 26.96 | 45.5 | 0.39 | 8.79 |
| 35 | 25.47 | 4.56 | 68.81 | 0.27 | 0.01 |

TABLE III

MAR-M-002 Al—Si as-coated

| DEPTH | % ELEMENT | | | | |
|---|---|---|---|---|---|
| MICRONS | AI | Cr | Ni | Co | Si |
| 5 | 31.81 | 1.01 | 55.56 | 6.86 | 4.38 |
| 10 | 25.04 | 10.07 | 44.43 | 5.6 | 13.54 |
| 15 | 31.2 | 2.15 | 53.81 | 6.98 | 5.5 |
| 20 | 32.73 | 0.64 | 56.25 | 7.57 | 2.74 |
| 25 | 31.89 | 0.7 | 56.64 | 8.11 | 2.24 |
| 30 | 30.94 | 4.48 | 52.1 | 10.52 | 1.99 |
| 35 | 27.01 | 5.18 | 57.31 | 9.01 | 0.57 |

TABLE IV

CM188LC PINS Al—Si as-coated (Low Silicon Ratio)

| DEPTH | % ELEMENT | | | | | | | |
|---|---|---|---|---|---|---|---|---|
| MICRONS | NI | AL | CR | SI | CO | W | TA | TI |
| 5 | 44.2 | 31.6 | 4.1 | 7.5 | 6.1 | 3.8 | 2.3 | 0.4 |
| 15 | 48.2 | 29.6 | 3 | 6.9 | 6.4 | 4.8 | 1.3 | 0 |
| 25 | 46.2 | 28.6 | 3 | 7.5 | 6.7 | 6 | 1.8 | 0.2 |
| 35 | 47.5 | 29.4 | 3.1 | 6.3 | 6.8 | 5.2 | 1.7 | 0.1 |
| 45 | 48.5 | 30.4 | 2.8 | 5.1 | 6.8 | 4.7 | 1.5 | 0.3 |
| 55 | 46.8 | 24.2 | 4.8 | 4.4 | 8.6 | 8 | 2.9 | 0.3 |
| 65 | 45.5 | 14.8 | 7.9 | 6.3 | 8.8 | 10.8 | 4.8 | 1.2 |

TABLE V

CM188LC PINS Al—Si as-coated (High Silicon Ratio)

| DEPTH | % ELEMENT | | | | | | | |
|---|---|---|---|---|---|---|---|---|
| MICRONS | NI | AL | CR | SI | CO | W | TA | TI |
| 5 | 56.6 | 30.5 | 0.4 | 6 | 5.6 | 0.94 | 0 | 0 |
| 15 | 51.33 | 26.9 | 4.1 | 8.48 | 5.6 | 2.5 | 0.9 | 0.3 |
| 25 | 51.9 | 26 | 2.6 | 7.1 | 6.9 | 3.2 | 2.19 | 0.1 |
| 35 | 53.6 | 27.6 | 1.47 | 4.9 | 8.6 | 2.3 | 1.54 | 0 |
| 45 | 56.9 | 24.6 | 2.9 | 3.3 | 8 | 2.6 | 1.5 | 0.3 |
| 55 | 46.29 | 14.9 | 5.8 | 8.9 | 8.9 | 10.6 | 3.8 | 0.9 |
| 65 | 45.29 | 13.3 | 7.1 | 8.3 | 8.8 | 12.7 | 4 | 0.7 |
| 75 | 45.5 | 15.1 | 7.8 | 6 | 9.6 | 11.4 | 3.7 | 1 |

TABLE VI

GX-4 Al—Si as coated

| DEPTH | % ELEMENT | | | | | | |
|---|---|---|---|---|---|---|---|
| MICRONS | AI | Si | Co | NI | Cr | Mo | Fe |
| 5 | 17 | 20 | 35 | 11 | 14 | 1.2 | 1.8 |
| 10 | 25 | 15 | 40 | 11 | 7 | 0.9 | 1.8 |
| 15 | 20 | 15 | 37 | 10.5 | 13 | 2.6 | 1.7 |
| 20 | 18 | 17 | 31 | 8 | 22 | 2.9 | 1.5 |
| 25 | 22 | 14 | 40 | 10 | 11 | 1.5 | 1.5 |
| 30 | 20 | 15 | 37 | 9 | 16 | 2.2 | 1.2 |
| 35 | 24 | 10 | 47 | 9 | 9 | 0.3 | 1.1 |
| 40 | 20 | 9 | 37 | 9 | 24 | 1.7 | 0.8 |
| 45 | 8 | 13 | 18 | 5 | 50 | 5.2 | 0.7 |
| 50 | 6 | 9 | 31 | 8 | 30 | 14 | 1.2 |
| 55 | 2 | 7.4 | 38 | 5 | 40 | 5.9 | 2.2 |
| 60 | 2 | 5.4 | 46 | 7.8 | 31 | 5.5 | 2.4 |
| 65 | 2 | 4.2 | 46 | 8.5 | 32 | 4.6 | 2.7 |
| 70 | 1.6 | 3.1 | 47 | 9.7 | 32 | 4.1 | 2.4 |

TABLE VII

COMPARISON OF COATED & DIFUSED

| Microns | t-Costs | I-Costs | t-Diffuse | I-Diffused |
|---|---|---|---|---|
| 5 | 30.4 | 31.8 | 34.9 | 27.5 |
| 10 | 35.1 | 30.8 | 37.0 | 27.6 |
| 15 | 36.9 | 28.4 | 36.5 | 28.2 |
| 20 | 37.8 | 28.5 | 32.5 | 28.0 |
| 25 | 35.4 | 29.1 | 28.5 | 28.5 |
| 30 | 17.1 | 32.6 | 14.8 | 30.8 |
| 35 | 13.8 | 32.4 | 11.8 | 31.4 |
| 40 | 8.4 | 33.5 | 7.5 | 32.5 |
| 45 | 6.7 | 32.8 | 5.7 | 31.4 |
| 50 | 2.9 | 32.3 | 2.2 | 31.1 |
| 55 | 3.6 | 24.0 | 1.5 | 29.7 |
| 60 | 0.0 | 19.1 | 0.0 | 25.4 |
| 65 | 2.1 | 18.4 | 0.0 | 20.8 |
| 70 | 0.0 | 17.9 | 0.0 | 16.9 |
| 75 | 0.0 | 11.8 | 0.0 | 16.2 |
| 80 | 0.0 | 9.1 | 0.0 | 14.7 |
| 85 | 0.0 | 9.1 | 0.0 | 16.0 |
| 90 | 0.0 | 8.9 | 0.0 | 13.7 |
| 95 | 0.0 | 7.6 | 0.0 | 9.4 |

TABLE VIII fPDSM Report

Input Pattern:

35C AI-SI COATING

| d | I | d | I | d | I | d | I | d | I |
|---|---|---|---|---|---|---|---|---|---|
| 2.8682 | 14 | 2.4130 | 4 | 2.2482 | 3 | 2.0263 | 100 | 1.4320 | 20 |
| 2.5519 | 2 | 2.3358 | 4 | 2.1028 | 9 | 1.6534 | 7 | 1.2812 | 3 |

Identified Phases:

| JCPDS# | SI | ML/X | At % Identity . . . |
|---|---|---|---|
| 2–1261 | 55 | 4/1 | 76 Aluminum Nickel = AlNi |
| | Ierr: 50, 500 | | derr: 2.0 Bground: 2 |
| | | | dmax/min: 2.884/1.277 |
| 32–0700 | 7 | 3/* | 6 Nickel Silicide = Ni3Si |
| | Ierr: 50, 500 | | derr: 2.0 Bground: 2 |
| | | | dmax/min: 2.884/1.277 |

TABLE VIII-continued fPDSM Report

Input Pattern:

35C AI-SI COATING
10
Summary Report:

| d | Full I | Resid I | 2–1261: d | 76% I | 32–0700: d | 6% I |
|---|---|---|---|---|---|---|
| 2.8682 | 14 | None | 2.87 | 30 | | |
| 2.5519 | 2 | None | | | 2.542 | 3 |
| 2.4130 | 4 | 4 | | | | |
| 2.3358 | 4 | 4 | | | <2.273 | 3> |
| 2.2482 | 3 | 3 | | | <2.138 | 6> |
| 2.1028 | 9 | 9 | | | | |
| 2.0263 | 100 | 18 | 2.02 | 76 | 2.024 | 6 |
| | | | | | <1.971 | 6> |
| | | | | | <1.759 | 5> |
| 1.6534 | 7 | None | 1.655 | 15 | | |
| | | | | | <1.567 | 3> |
| | | | | | <1.545 | 2> |
| | | | | | <1.459 | 3> |
| 1.4320 | 20 | None | 1.434 | 15 | | |
| | | | <1.285 | 8> | <1.403 | 2> |
| | | | | | <1.365 | 3> |
| | | | | | <1.316 | 5> |
| 1.2812 | 3 | None | | | 1.283 | 3 |

* = Obscured
< . . . > = Missing
[ . . . ] = Previously Removed

TABLE IX

Omni Instruments Auto-xRay Analysis Report
Omni Instruments
Data file: 35d.d1
Comment: 35D AL-SI COATING
Wavelength: 1.54178 Angstroms

| Center | Height | Area | D |
|---|---|---|---|
| 30.83687 | 504 | 6936 | 2.89954 |
| 35.18838 | 200 | 271 | 2.55031 |
| 37.94006 | 136 | 370 | 2.37143 |
| 40.27991 | 208 | −207 | 2.23891 |
| 40.84195 | 252 | 965 | 2.21079 |
| 44.38614 | 4052 | 53870 | 2.04086 |
| 55.24129 | 589 | 3518 | 1.66278 |
| 64.70628 | 730 | 8968 | 1.44055 |
| 73.49693 | 201 | 283 | 1.28846 |

TABLE X fPDSM Report

Input Pattern:

35C AL-SI COATING
9

| d | I | d | I | d | I | d | I | d | I |
|---|---|---|---|---|---|---|---|---|---|
| 2.8885 | 12 | 2.3714 | 3 | 2.2108 | 6 | 1.6628 | 15 | 1.2885 | 5 |
| 2.5503 | 5 | 2.2389 | 5 | 2.0409 | 100 | 1.4405 | 18 | | |

Identified Phases:

| JCPDS# | SI | ML/X | At % Identity . . . |
|---|---|---|---|
| 20–0019C | 59 | 4/0 | 95 *Aluminum Nickel = AlNi |
| | Ierr: 50, 500 | | derr: 2.0 Bground: 3 |
| | | | dmax/min: 2.916/1.285 |

TABLE X-continued fPDSM Report

Input Pattern:

35C AL-SI COATING
9
Summary Report:

| d | Full I | Resid I | 20–0019: d | 95% I |
|---|---|---|---|---|
| 2.8995 | 12 | None | 2.89 | 26 |
| 2.5503 | 5 | 5 | | |
| 2.3714 | 3 | 3 | | |
| 2.2389 | 5 | 5 | | |
| 2.2108 | 6 | 6 | | |
| 2.0409 | 100 | None | 2.04 | 95 |
| 1.6628 | 15 | 10 | 1.667 | 5* |
| 1.4405 | 18 | None | 1.444 | 12 |
| 1.2885 | 5 | None | 1.291 | 5 |

* = Obscured
< . . . > = Missing
[ . . . ] = Previously Removed

TABLE XI

Omni Instruments Auto-xRay Analysis Report
Omni Instruments
Data file: 37c.d1
Comment: 37C AL-SI COATING
Wavelength: 1.54178 Angstroms

| Center | Height | Area | D |
|---|---|---|---|
| 31.31942 | 464 | 4205 | 2.85596 |
| 39.06890 | 152 | 481 | 2.30547 |
| 43.58455 | 349 | 585 | 2.07651 |
| 44.80302 | 6342 | 58174 | 2.02283 |
| 55.62892 | 279 | 1522 | 1.65211 |
| 65.12015 | 743 | 6753 | 1.43239 |
| 73.87484 | 179 | 694 | 1.28280 |

TABLE X fPDSM Report

Input Pattern:

37C AL-SI COATING
7

| d | I | d | I | d | I | d | I | d | I |
|---|---|---|---|---|---|---|---|---|---|
| 2.8560 | 7 | 2.0765 | 6 | 1.6521 | 4 | 1.2828 | | 3 | |
| 2.3055 | 2 | 2.0228 | 100 | 1.4324 | 12 | | | | |

Identified Phases:

| JCPDS# | SI | ML/X | At % Identity . . . |
|---|---|---|---|
| 12–1261 | 60 | 5/0 | 66 Aluminum Nickel = AlNi |
| | Ierr: 50, 500 | | derr: 2.0 Bground: 2 |
| | | | dmax/min: 2.872/1.279 |

Summary Report:

| d | Full I | Resid I | 2–1261: d | 66% I |
|---|---|---|---|---|
| 2.8560 | 7 | None | 2.87 | 26 |
| 2.3055 | 2 | 2 | | |
| 2.0765 | 6 | 6 | | |
| 2.0228 | 100 | 34 | 2.02 | 66 |

TABLE X-continued fPDSM Report

Input Pattern:

37C AL-SI COATING
7

| | | | | |
|---|---|---|---|---|
| 1.6521 | 4 | None | 1.655 | 13 |
| 1.4324 | 12 | None | 1.434 | 13 |
| 1.2828 | 3 | None | 1.285 | 7 |

* = Obscured
< . . . > = Missing
[ . . . ] = Previously Removed

TABLE XIII

Omni Instruments Auto-xRay Analysis Report
Omni Instruments
Data file: 37d.d1
Comment: 37D AL-SI COATING
Wavelength: 1.54178 Angstroms

| Center | Height | Area | D |
|---|---|---|---|
| 31.52626 | 258 | 1497 | 2.83769 |
| 35.56687 | 132 | 449 | 2.52403 |
| 36.23339 | 122 | 223 | 2.47912 |
| 40.81715 | 183 | 422 | 2.21068 |
| 42.11810 | 131 | 107 | 2.14535 |
| 43.45442 | 345 | −278 | 2.08243 |
| 44.92110 | 3685 | 45967 | 2.01779 |
| 47.42839 | 156 | 257 | 1.91680 |
| 55.83552 | 202 | 754 | 1.64648 |
| 65.48686 | 493 | 4841 | 1.42526 |
| 72.41316 | 117 | 107 | 1.30505 |
| 74.28386 | 149 | −11 | 1.27675 |

TABLE XIV fPDSM Report

Input Pattern:

37D SI-AL COATING
10

| d | I | d | I | d | I | d | I | d | I |
|---|---|---|---|---|---|---|---|---|---|
| 2.8377 | 7 | 2.5273 | 4 | 2.0824 | 9 | 1.9168 | 4 | 1.4253 | 13 |
| 2.6983 | 3 | 2.2107 | 5 | 2.0178 | 100 | 1.6465 | 5 | 1.2799 | 4 |

Identified Phases:

| JCPDS# | SI | ML/X | At % Identity . . . |
|---|---|---|---|
| 14–0429D | 6 | 3/4 | 4 Nickel Silicide = Ni3Si2 |
| | Ierr: 50, 500 | | derr: 2.0 Bground: 3 |
| | | | dmax/min: 2.853/1.276 |
| 32–06990 | <0 | 2/6 | 12 Nickel Silicide = Ni3Si |
| | Ierr: 50, 500 | | derr: 2.0 Bground: 3 |
| | | | dmax/min: 2.853/1.276 |

Summary Report:

| d | Full I | Resid I | 14–0429: 4% d | I | 32–00699: 12% d | I |
|---|---|---|---|---|---|---|
| 2.8377 | 7 | 7 | | | | |
| 2.6983 | 3 | None | 2.700 | 2 | | |
| 2.5273 | 4 | 4 | | | <2.446 | 7> |
| 2.2107 | 5 | 5 | | | <2.122 | 5> |

TABLE XIV-continued fPDSM Report

Input Pattern:

37D SI-AL COATING
10

| | | | | | | |
|---|---|---|---|---|---|---|
| 2.0824 | 9 | None | <2.038 | 4> | 2.075 | 5 |
| 2.0178 | 100 | 84 | 2.011 | 4* | 2.011 | 12* |
| | | | <1.975 | 4> | <1.964 | 9> |
| 1.9168 | 4 | None | 1.920 | 0 | [1.915 | 9] |
| " | " | | 1.910 | 3 | | |
| | | | <1.747 | 3> | <1.741 | 13> |
| 1.6465 | 5 | 5 | | | 1.564 | 5> |
| 1.4253 | 13 | 8 | | | 1.429 | 5 |
| | | | | | <1.376 | 5> |
| 1.2799 | 4 | 4 | | | | |

* = Obscured
< . . . > = Missing
[ . . . ] = Previously Removed

What is claimed is:

1. An aluminide-silicide coating formed in part by vapor deposition of aluminum and silicon on a superalloy substrate for providing protection against sulfidation attack at 800° C. and oxidation resistance at 1121° C., the coating comprising less than 32 weight % Al, at least 6 weight % Si, and having a Si/Al weight ratio of between about 0.2 to about 0.4, and at least three distinct aluminide zones, wherein the outer most zone relative to the substrate is nearly free of chromium, and the innermost zone relative to the substrate contains the highest levels of silicon.

2. The aluminide suicide coating of claim 1, wherein the average weight percent of Al in the coating is about 24 to about 28.

3. The aluminide silicide coating of claim 1, wherein the average weight percent of Si in the coating is about 6 to about 9.

4. The aluminide suicide coating of claim 1, wherein the Si/Al weight ratio in the coating is between about 0.22 to about 0.32.

5. A superalloy turbine part coated with an aluminide-silicide coating formed in part by vapor deposition of aluminum and silicon for improved resistance to oxidation and sulfidation, the coating comprising less than 32 weight % Al, at least 6 weight % Si, and having a Si/Al weight ratio of between about 0.2 to about 0.4, and at least three distinct aluminide zones, wherein the outer most zone relative to the substrate is nearly free of chromium, and the innermost zone relative to the substrate contains the highest levels of silicon.

6. The superalloy turbine part of claim 5, wherein the average weight percent of Al in the coating is about 24 to about 28.

7. The superalloy turbine part of claim 5, wherein the average weight percent of Si in the coating is about 6 to about 9.

8. The superalloy turbine part of claim 5, wherein the Si/Al weight ratio in the coating is between about 0.22 to about 0.32.

* * * * *

UNITED STATES PATENT AND TRADEMARK OFFICE

CERTIFICATE OF CORRECTION

PATENT NO. : 6,620,518 B2 
DATED : September 16, 2003
INVENTOR(S) : Patrick R. Laverly et al.

It is certified that error appears in the above-identified patent and that said Letters Patent is hereby corrected as shown below:

Title page,
Insert:
-- [73] Assignee: Walbar Inc.
Peabody, MA --

Signed and Sealed this

Eleventh Day of May, 2004

JON W. DUDAS
*Acting Director of the United States Patent and Trademark Office*